US012612792B2

(12) United States Patent
Baggaley

(10) Patent No.: US 12,612,792 B2
(45) Date of Patent: Apr. 28, 2026

(54) CONCRETE WORKING TOOL AND KIT FOR MAKING THE SAME

(71) Applicant: Bryan Baggaley, Holladay, UT (US)

(72) Inventor: Bryan Baggaley, Holladay, UT (US)

( * ) Notice: Subject to any disclaimer, the term of this patent is extended or adjusted under 35 U.S.C. 154(b) by 858 days.

(21) Appl. No.: 17/897,160

(22) Filed: Aug. 27, 2022

(65) Prior Publication Data

US 2023/0074536 A1 Mar. 9, 2023

Related U.S. Application Data

(60) Provisional application No. 63/242,001, filed on Sep. 8, 2021.

(51) Int. Cl.
*E04G 21/10* (2006.01)

(52) U.S. Cl.
CPC ..... *E04G 21/10* (2013.01)

(58) Field of Classification Search
CPC ..... E04G 21/10
USPC ..... 404/134, 72–118
See application file for complete search history.

(56) References Cited

U.S. PATENT DOCUMENTS 4,105,355 A * 8/1978 King ..... E01C 19/402 404/114
4,298,555 A 11/1981 Weltmer
4,520,527 A * 6/1985 Maggio ..... E04F 21/244 74/105
4,795,332 A 1/1989 Davis
4,828,427 A * 5/1989 Nisenbaum ..... E04F 21/06 404/97
7,252,332 B2 * 8/2007 Thompson ..... B64D 11/0643 297/217.3
7,296,948 B2 11/2007 Mikhaylenko
7,470,083 B2 12/2008 Black
7,476,053 B2 * 1/2009 Face, III ..... E01C 19/42 404/112
8,277,144 B1 * 10/2012 Bayley ..... E04F 21/244 15/235.4
2007/0166104 A1 * 7/2007 Face, III ..... E04F 21/241 404/118
2008/0031687 A1 * 2/2008 Frankeny ..... E04F 21/24 404/84.1
2010/0202831 A1 8/2010 Saranga
2015/0252576 A1 * 9/2015 Parr ..... E01C 19/508 249/191

FOREIGN PATENT DOCUMENTS

AU 2006236000 11/2006

* cited by examiner

*Primary Examiner* — Raymond W Addie
(74) *Attorney, Agent, or Firm* — BATEMAN IP; Randall B. Bateman

(57) ABSTRACT

A concrete working tool may include a pivot bearing attached to a first attachment bracket, a second attachment bracket and a screed board attached to the first attachment bracket and the second attachment bracket. The pivot bearing may be attached to the first attachment bracket by a hinge and the second attachment bracket may include a swivel with a handle attachment attached thereto. A kit for making a concrete working tool may include the pivot bearing and first attachment bracket and the second attachment bracket.

20 Claims, 6 Drawing Sheets

CONCRETE WORKING TOOL AND KIT FOR MAKING THE SAME

BACKGROUND

Field of the Art

The present disclosure relates to a tool for leveling semi flowable material. In particular, the present disclosure relates to a concrete working tool which may be used to screed concrete.

State of the Art

The preparation of certain flowable materials such as concrete is a physically demanding task. First, the surface on which the material will be laid must be prepared and forms set in place to define the parameters of the surface being laid. For concrete slabs this typically includes placing 2×4s or 2×6s in the shape of the perimeters of the pour and pounding stakes into the ground to hold the forms in place. For small concrete jobs the person laying the concrete may simply mix the concrete components with water and mix them in a wheelbarrow or the like prior to pouring the mixture into the area defined by the forms. A small mixer may also be used to ensure that the water and the concrete components are thoroughly mixed.

For large concrete pours one or more mixing trucks, each holding several cubic yards of mixed concrete, will arrive and extend a boom into the area in which the concrete is to be laid. As the concrete mixture comes out of the boom, workers spread the concrete mixture in order to try to get the concrete mixture as even as possible.

Once the concrete mixture has been spread out so that it is generally even, the concrete is screeded. Screeding involves taking a board, a piece of aluminum, or other similar material, that has a flat edge, disposing it on opposite sides of the forms and dragging the board across the wet concrete. The board, etc., removes any concrete which extends above the top of the forms and fills in any voids in the concrete below the tops of the forms. On a very small job this can be done by an individual holding the screed board near the middle and dragging the board toward himself or herself. However, because most concrete pours are at least 10'×10', screeding usually requires a person on both ends of the board.

Screeding can be physically demanding. Not only are the persons doing the screeding usually on their knees, but they are also dragging a large board pushing excess concrete and filling voids located in the pour area. The process can place substantial strain on the knees and back of those doing the screeding.

There have been numerous attempts to provide alternative mechanisms for screeding. Some attempts use a pivot point which gets mounted in and remains in the concrete. While this makes the screeding easier, it results in the pivot point remaining in the concrete and is problematic for driveways and the floors of buildings in which the pivot point cannot be ready covered.

Other attempts have been made to use powered equipment which screeds the concrete either with a screw or with vibrators. While such devices can be useful, they can also be expensive and somewhat cumbersome to carry around.

Still other devices are designed to screed the concrete so as to leave a conical depression, such as the drain in a bathroom or a basement. While such devices work well for forming the slope into the concrete, they are generally problematic for use in forming flat surfaces.

Thus, it is an object of the present disclosure to provide a concrete working tool, and/or a kit containing portions thereof, which facilitates the screening of concrete in a less expensive and/or less physically demanding manner.

SUMMARY

The following summary of the present disclosure is not intended to describe each illustrated embodiment, or every possible implementation of the concrete working tool and methods discussed herein, but rather to give illustrative examples of application of principles of the present disclosure.

In accordance with one aspect of the present disclosure, a kit may be provided for forming a concrete working tool. A kit may include a pivot shaft or bearing for rotating about a stake and an attachment bracket for attaching the pivot bearing to a board.

In one or more embodiments, the pivot bearing may be attached to the attachment bracket by a hinge to allow the attachment bracket to pivot with respect to the pivot bearing.

In one or more embodiments, the attachment bracket may be generally U-shaped and may have a plurality of holes formed therein.

In one or more embodiments the pivot bearing may be generally cylindrical and having a void extending therethrough.

In one or more embodiments, the pivot bearing may be formed from a plurality of rings disposed in alignment.

In one or more embodiments, the pivot bearing may have a long axis and the hinge may allow the attachment bracket to pivot in alignment with the long axis.

In one or more embodiments, the cap may also include a second attachment bracket.

In one or more embodiments, the second attachment bracket may include a handle adapter for attaching a handle.

In one or more embodiments, the handle adapter may be threaded and configured to receive a threaded handle.

In one or more embodiments, the second attachment may include a handle swivel for enabling a handle attached to the second attachment to rotate relative to the second attachment.

In one or more embodiments, an elongate board may be attached to the first attachment bracket at one end of the board and to the second attachment in the opposing end of board.

In one or more embodiments, a formwork stake includes with one or more retainers, such as pins, nails, screws, or bolts.

In one or more embodiments, the formwork stake extends through the pivot bearing and one or more of the retainers extends through the formwork stake to limit movement of the pivot bearing along the formwork stake.

In accordance with a method of the present disclosure, a formwork stake may be driven into the surface on which the concrete will be poured. The pivot bearing may be mounted on the formwork stake and one or more retainers slid into holes in the formwork stake to limit vertical movement of the pivot bearing.

In accordance with another aspect of the method of the present disclosure, a board may be attached to the first attachment bracket either before or after the pivot bearing is disposed on the formwork stake.

In accordance with another aspect of the method of the present disclosure, the second attachment bracket may be attached to the opposing end of the elongate board. A handle may be attached to the second attachment bracket either before or after that is attached to the elongate board.

In accordance with another aspect of the method of the present disclosure, the handle can be used to drag the second attachment bracket and/or the elongate board along the top of forms defining the perimeter of a pour to thereby screed concrete disposed under the arc formed by rotating the elongate board about the formwork stake.

In another aspect of the method of the present disclosure, once an area has been screeded, the user may remove the formwork stake and relocate it to another area in which concrete is being poured.

It will be appreciated that different embodiments or methods may include some aspects discussed herein and not others, and that the scope of the disclosure provided herein is defined by the appended claims.

BRIEF DESCRIPTION OF THE DRAWINGS

Various embodiments of the present disclosure are shown and described in reference to the numbered drawings wherein.

Figure 1:
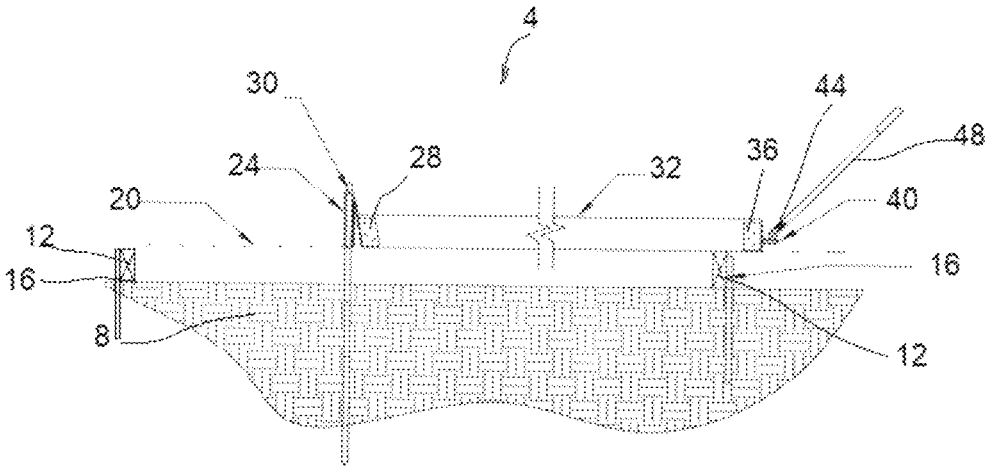
FIG. 1 illustrates a side view of a concrete working tool disposed to screed concrete to be laid upon the ground or other surface.

It will be appreciated that the drawings are illustrative and not limiting of the scope of the invention which is defined by the appended claims. The embodiments shown accomplish various aspects and objects of the invention. It will be appreciated that it is not possible to clearly show each element and aspect of the present disclosure in a single figure, and as such, multiple figures are presented to separately illustrate the various details of different aspects of the invention in greater clarity. Similarly, not all configurations or embodiments described herein or covered by the appended claims will include all of the aspects of the present disclosure as discussed above.

DETAILED DESCRIPTION

Various aspects of the invention and accompanying drawings will now be discussed in reference to the numerals provided therein so as to enable one skilled in the art to practice the present invention. The skilled artisan will understand, however, that the methods described below can be practiced without employing these specific details, or that they can be used for purposes other than those described herein. Indeed, they can be modified and can be used in conjunction with products and techniques known to those of skill in the art in light of the present disclosure. The drawings and the descriptions thereof are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one embodiment," "one configuration," "an embodiment," or "a configuration" means that a particular feature, structure, or characteristic described in connection with the embodiment may be included in at least one embodiment, etc. The appearances of the phrase "in one embodiment" in various places may not necessarily limit the inclusion of a particular element of the invention to a single embodiment, rather the element may be included in other, or all embodiments discussed herein.

Furthermore, the described features, structures, or characteristics of embodiments of the present disclosure may be combined in any suitable manner in one or more embodiments. In the following description, numerous specific details may be provided, such as examples of products or manufacturing techniques that may be used, to provide a thorough understanding of embodiments of the invention. One skilled in the relevant art will recognize, however, that embodiments discussed in the disclosure may be practiced without one or more of the specific details, or with other methods, components, materials, and so forth. In other instances, well-known structures, materials, or operations may not be shown or described in detail to avoid obscuring aspects of the invention.

Before the present invention is disclosed and described in detail, it should be understood that the present invention is not limited to any particular structures, process steps, or materials discussed or disclosed herein, but is extended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect is required to be present apart from an express inclusion of that aspect in the claims.

It should also be noted that, as used in this specification and the appended claims, singular forms such as "a," "an," and "the" may include the plural unless the context clearly dictates otherwise. Thus, for example, reference to "a bracket" may include an embodiment having one or more of such brackets, and reference to "the target plate" may include reference to one or more of such target plates.

As used herein, the term "substantially" refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that enclosing nearly all of the length of a lumen would be substantially enclosed, even if the distal end of the structure enclosing the lumen had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom.

As used herein, the term "generally" refers to something that has characteristics of a quality without necessarily being exactly that quality. For example, a structure said to be generally vertical would be at least as vertical as horizontal, i.e., would extend 45 degrees or greater from horizontal. Likewise, something said to be generally circular may be rounded like an oval but need not have a consistent diameter in every direction.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range, or the characteristics being described.

Turning now to FIG. 1, there is shown a side view of a completed concrete working tool, generally indicated at 4. In the preparation of concrete, a surface 8, such as the ground is prepared and forms 12 are disposed to identify the perimeter of the concrete to be poured. The forms 12 are normally held in place by formwork stakes 16. One common type of formwork stake is circular in cross-section and can range from 12 to 48 inches long, and have holes formed therein at predetermined distances. The length of concrete stake used will depend on conditions such as the firmness of the soil on which the concrete is being poured.

In conventional screeding, a board, aluminum, or some other form with a generally flat bottom, (commonly referred to as a screed board), is pulled across the top of the forms 8 and concrete so that a flat surface is formed along a line extending between the top of the forms as indicated by dashed line 20. If the distance between the forms is more than about 6 feet, screeding usually takes two people to perform, with one person holding each end of the screed board.

Figure 2:
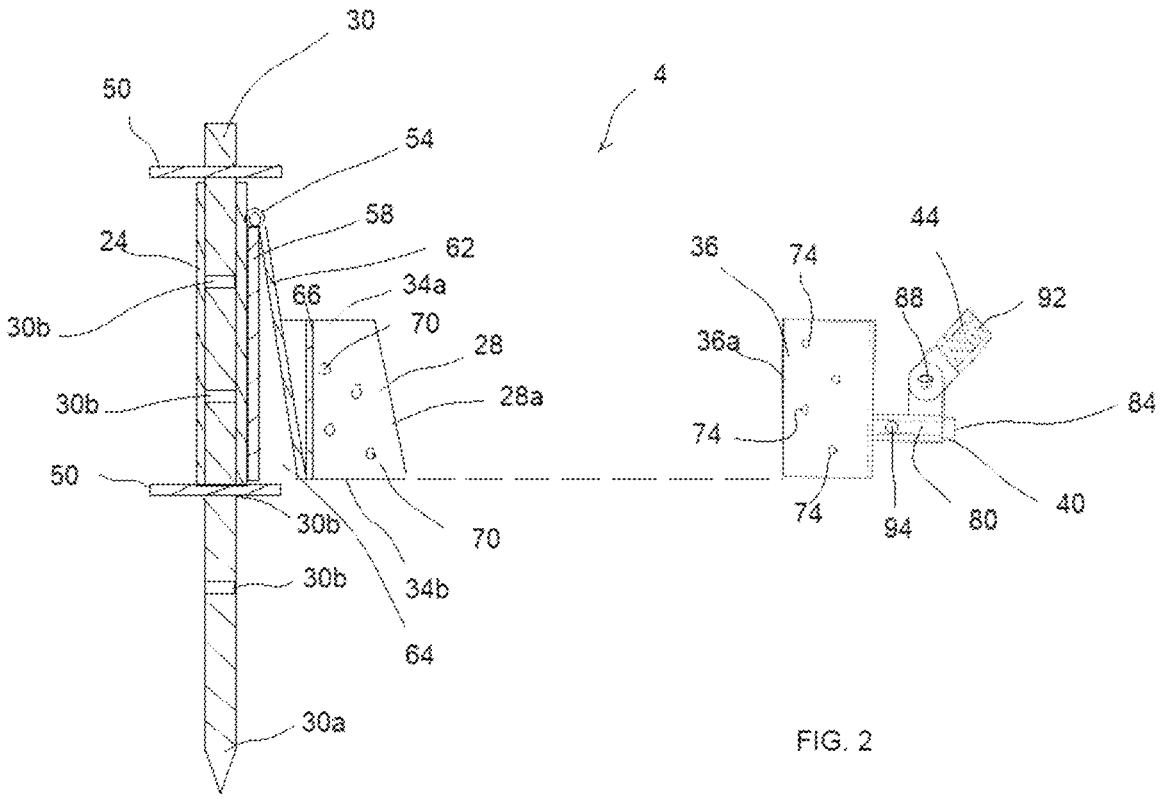
FIG. 2 shows a cross-sectional view of various components of the concrete working tool.

The concrete working tool 4 of the present disclosure solves these problems by providing a pivot bearing 24, such as a cylindrical tube, with a first attachment bracket 28 attached to the pivot bearing with a hinge 54 (FIG. 2). The pivot bearing 24 is designed to rotate about a formwork stake 30, as will be explained in additional detail below. A board 32 may be attached to the first attachment bracket 28 on one end, and a second attachment bracket 36 on an opposing end of the board so the board can be used as a screed board. (This may occur before or after the pivot bearing 24 is disposed on the formwork stake 30). The second attachment bracket 36 may have a swivel 40 formed by a rod and a pivot bearing (discussed in additional detail below) and a handle attachment 44. The handle attachment 44 may be threaded so as to receive a common broom handle 48 or other type of handle.

Rather than requiring two workers to get down on their knees and drag the screed board across the tops of the forms 8 to screed the concrete, the present disclosure allows a single individual to screed the concrete and allows them to remain upright while doing so. The worker screeding the concrete with the concrete working tool 4 simply grabs the handle 48 and commences walking in a generally circular pattern with the screed board 32 or second attachment bracket 36 resting on the forms 12. The user may change directions if necessary and lift the board to ensure that concrete is pushed into any voids below the top of the forms 12 as indicated by the dashed line 20. It will be appreciated that the screed board 32 or second attachment bracket can also rest on previously hardened concrete and can be used for floating on top of previously leveled and screeded concrete.

In smaller pours using a 14-foot or 16-foot-long screed board, a single person can screed the entire pour without moving the framework stake 30. For larger pours, the framework stake 30 can be removed and placed in a new area multiple times to allow the entire area to be screeded. Because framework stakes 30 are typically about ¾ths of an inch in diameter and are anchored in the ground, the hole left by removing the stake can be easily filled in so that the concrete has a continuous surface. This is unlike some arcuate screeding devices which leave an anchor in the concrete.

Turning now to FIG. 2, there is shown a close-up, cross-sectional side view of portions of the concrete working tool 4. As mentioned previously, the framework stake 30 may have a plurality of holes **30*b* disposed therein. The pivot bearing 24 is disposed about the formwork stake 30 and may be sized so that the top of the pivot bearing will be disposed just below one hole when the bottom of the pivot bearing is disposed just above a second hole. One retainer 50 may be placed in the lower hole 30*b* in the framework stake 30 so that the pivot bearing 24 may rest on the retainer while the pivot bearing rotates. The retainer 50 may be a nail, a screw, a bolt, or a pin which fits into the framework stake. It will be appreciated that a framework stake could also be formed with a flange at the desired height for maintaining the height of the pivot bearing 24** as it is being rotated.

A second retainer 50 may be inserted in the hole **30*b* immediately above the pivot bearing 24 to prevent the pivot bearing from moving upwardly as the screed board 32 (FIG. 1) engages concrete which is piled higher than the top of the forms 12 (FIG. 1**).

The pivot bearing 24 may be formed by a cylindrical tube having an interior diameter just larger than the outer diameter of the formwork stake 30. Many common framework stakes have a diameter of ¾ths of an inch. Thus, the pivot bearing 24 may have an interior diameter of just greater than ¾ths of an inch. It will be appreciated that the pivot bearing 24 need not be a single tube or be completely cylindrical. For example, a slot could be formed in the bearing of a plurality of smaller bearings or even rings could be used to allow the first attachment bracket 28 to rotate about formwork stake 30.

The pivot bearing 24 is attached to a hinge 54. This may be accomplished, for example, by welding a first arm 58 of the hinge 54 to the exterior of the pivot bearing 24. Other attachment mechanisms such as adhesives or mechanical fasteners could also be used.

A second arm 62 of the hinge may be attached to one or more metal plates 28*a* and 28*b* (FIG. 4) to form the first attachment bracket 28. In a presently preferred embodiment, the metal plates may be formed from ⅛-inch steel plate. However, other sizes and materials may also be used. The metal plates 28*a* and/or 28*b* may include a plurality of holes 70 through which screws, bolts, or other mechanical fasteners 81 can be used to engage and hold a screed board (32, FIG. 1). Clamps and other fastening mechanisms may also be used to secure the screed board.

A gap 64 between the first arm 58 and the second arm 62 of the hinge 54 may be provided to accommodate concrete with sloped surfaces, such as a section which may require a small downward slope. Additionally, the gap 64 can be used to compensate in the event that the stake 30 is driven in at a slight angle.

Figure 9:
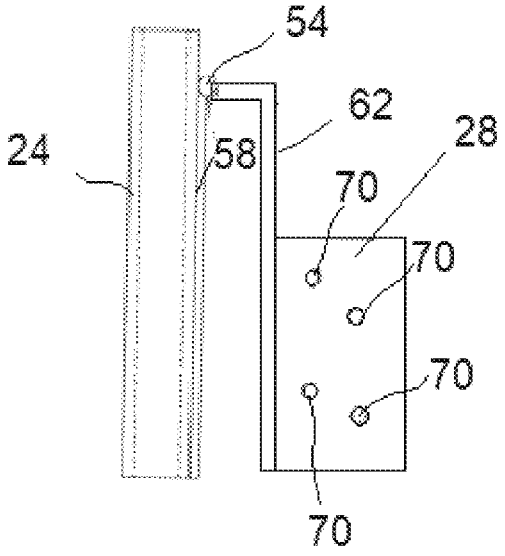
FIG. 9 shows an alternate configuration of a hinge used to attach the pivot bearing to the attachment bracket.

The screed board 32 (FIG. 1) can be attached to the first attachment bracket 28 by cutting the end of the board to match the slope of the second arm 62. Alternatively, a butting plate 66 may be added in the first attachment bracket 28 so that the end of the screed board has a flat surface to but up to. By way of another alternative, the second arm 62 may include a bend so that in a resting position at least a portion of it is generally parallel with the first arm 58 of the hinge 54 as shown in FIG. 9. In one preferred embodiment, the space between the first arm 58 and the second arm 62 is about 0.5 inches.

In its resting position, a bottom 34*b* of the metal plates 28*a* or 28*b* may be positioned to align with the ideal bottom of the screed board. The top 34*a* of the metal plates 28*a* and 28*b* may be sized to align with the top of a 2×4 or 2×6 screed board. While the present disclosure will likely most often be used with wood screed boards, it will be appreciated that aluminum screed boards could also be attached to the first attachment bracket 28. Additionally, it will be appreciated that a screed board could be permanently attached to the attachment bracket 28 and/or second arm 62.

Also shown in FIG. 2 is the second attachment bracket 36. The second attachment bracket 36 includes one or more metal plates, such as plate 36*a* or 36*b* (FIG. 4), which may be made in a manner similar to that discussed with respect to the first attachment bracket 28. A plurality of holes 74 may be formed in the attachment bracket 28 for facilitating attachment of the screed board 32 (FIG. 1). The second attachment bracket 36 may include a swivel 40 which is formed by a shank 84 and a swivel bearing 80 which rotates about the shank. The shank may be larger on an end opposite the metal plates 36*a*, 36*b* of the attachment bracket to hold the bearing in place. The shank may be welded to the remainder of the attachment bracket or maybe attached by adhesives or mechanical fasteners.

Attached to the swivel bearing 80 may be a handle attachment 44. The handle attachment 44 may include a handle pivot 88 which can adjust the orientation of a threaded receptacle or void 92 which receives a threaded end of a broom handle. Alternatively, the handle attachment may include some other form of void for receiving one end of a handle. The handle pivot 88 allows a user to adjust a handle attached to the handle attachment 44 so that the handle is disposed at a comfortable angle while they use the concrete working tool 4 of the present disclosure. For example, if a portion of the concrete pad being laid was an elevated height, such as in a tiered patio or amphitheater, the handle pivot 88 can be loosened and the handle attachment adjusted so that the handle extended more horizontally. Likewise, if there was an obstruction adjacent the form 12 as shown in FIG. 1, the handle can be disposed vertically or even leaning over the screed board if necessary.

It will also be appreciated that the swivel 40 could have a locking mechanism so as to selectively prevent the swivel bearing 80 from rotating about the shank 84. This could be accomplished, for example, by inserting a pin 94 which extends through the swivel bearing 80 and into or through the shank 84. Thus, a user can selectively utilize the swivel feature or prevent the swiveling depending on the particular circumstances of the concrete being excreted and other personal preferences working tool.

Figure 3:
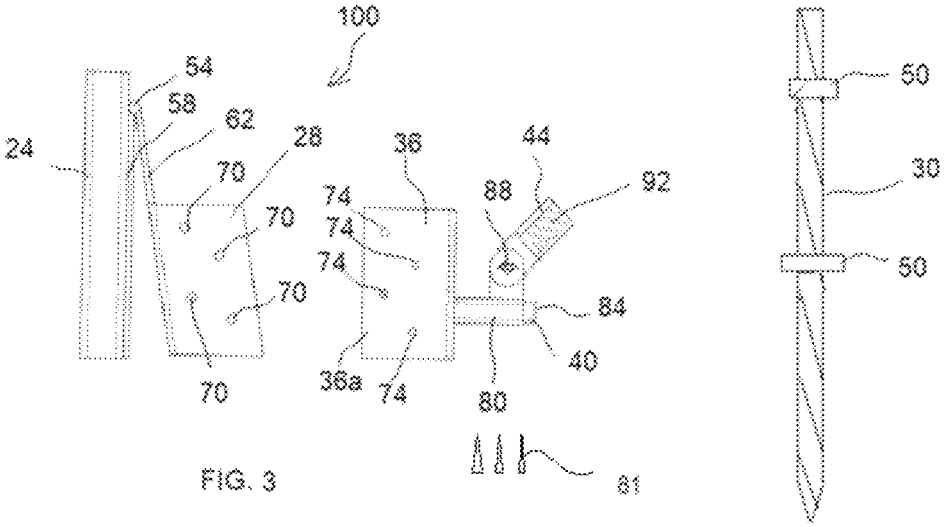
FIG. 3 shows a kit for making a concrete working tool in accordance with the present disclosure.

Turning now to FIG. 3, there is shown a kit, generally indicated at 100 for making a concrete working tool, such as the concrete working tool 4 shown in FIG. 1. One of the advantages of the concrete tool discussed in regard to FIGS. 1 and 2 is its simplicity of design and use of commonly available components which a concrete installer would typically have. Rather than specialized components that would require considerable space to ship and would be expensive, the concrete working tool 4 can be formed by an inexpensive kit, along with framework stake, 2×4 and handle which would already be owned by a concrete contractor or mason.

The kit 100 may include a pivot bearing 24 attached to an attachment bracket 28. As with the concrete working tool discussed previously, the pivot bearing 24 may be attached to the attachment bracket 28 by a hinge 54. This may include the pivot bearing 24 being welded or otherwise attached to a first arm 58 of the hinge 54, and a second arm 62 of the hinge being welded or otherwise attached to one or more metal plates 28*a*, 28*b*, for attachment to a 2×4 to form the screed board.

The kit 100 may also include a second attachment bracket 36 which includes one or more metal plates 36*a*, 36*b* (FIG. 4) for attachment to an end of the screed board opposite the first attachment bracket 28. The metal plates may have a plurality of holes 74 for inserting screws or other fasteners. The second attachment bracket may also include the swivel 40 formed by a swivel bearing 80 which rotates about a shank 84. A handle attachment 44 may be welded or otherwise attached to the swivel bearing 80 may include an adjustment joint 88 and a receptacle or void 92, which may be threaded or otherwise configured to receive the end of the handle.

The kit 100 allows a worker to carry the essential components of a concrete working tool such as that shown in FIG. 1 in a small bag. On a concrete installation worksite, a worker would likely find a spare framework stake, 2×4 and broom handle which could be used to complete the assembly of concrete working tool. In a manner of a couple of minutes the worker could put the attachment brackets 28 and 36 on opposite ends of a 2×4 by driving a plurality of screws. A broom handle could be threadedly engaged into the void 92 in the second attachment bracket and the framework stake could be inserted into the pivot bearing 24 and one or more pins, screws, bolts, etc. inserted into the framework stake to hold the pivot bearing in place. It will be appreciated that often the framework stake will be driven into the ground so that a lower of two holes is disposed just about the desired level of the concrete prior to the pour. Once the concrete is in place, the pivot bearing 24 can be slid onto the framework stake and secured by placing a second retainer just above the top of the pivot bearing. The device is ready to use. If multiple different areas of concrete need to be covered, the framework stake can be pulled out of the ground and relocated to the next area in the concrete and the worker with a trowel can fill in a small void in the concrete left by the framework stake.

It will be appreciated that the kit 100 may also include a stake 30 and retainers 50. While such are readily available on a typical concrete poor, the stake 30 and retainers 50 may be less available for an individual finishing their own concrete. Thus, it will be appreciated that the kits may contain additional items as well.

Figure 4:
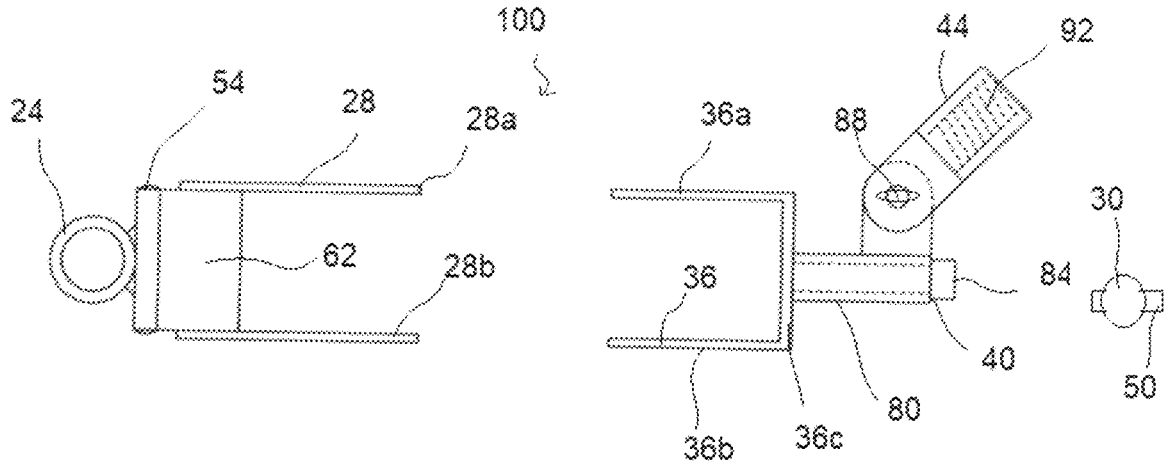
FIG. 4 shows a top view of the kit shown in FIG. 3.

FIG. 4 shows a top view of the kit 100 shown in FIG. 3. The first attachment bracket 28 may be formed by two metal plates 28*a* and 28*b* to receive one end of a 2×4, an aluminum screed board, etc. The metal plates 28*a* and 28*b* may be welded or otherwise attached to the second arm 62 hinge 54, while a first arm (not visible) may be welded or otherwise attached to the pivot bearing 24.

The second attachment bracket 36 may be formed by a first metal plate 36*a* and a second metal plate 36*b* being welded to a third metal plate 36*c*. Alternatively, a single plate to be formed in a U-shape or other configuration for attachment to one end of the screed board. The shank 84 of the swivel attachment 40 may be welded to the one or more plates or could be mechanically attached, such as by the shank 84 having a threaded void in the carriage bolt or similar fastener being inserted through the plate to engage the threaded void.

Figure 5:
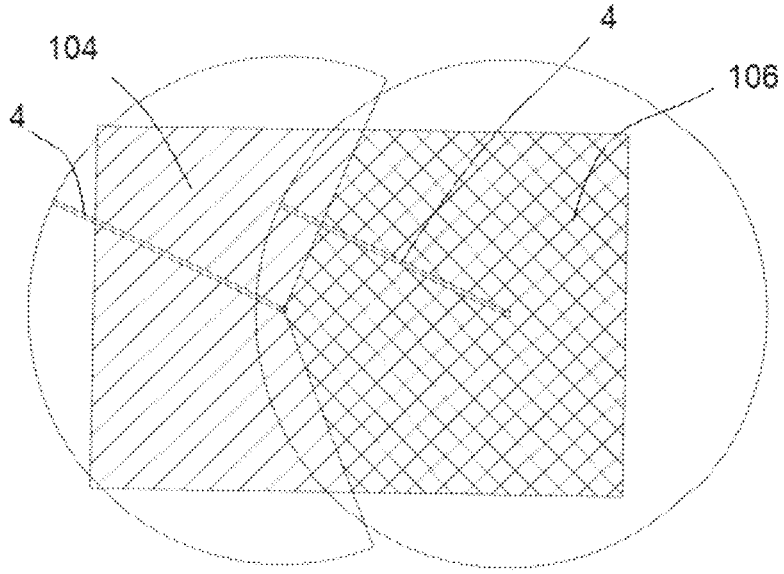
FIG. 5 shows an example of an area 14'×20' being screeded with the concrete working tool consistent with the present disclosure.

Turning now to FIG. 5 there is shown how a single person can screed the area larger than the length of the screed board. A first area 104 is screeded and then the framework stake or other pivot point is removed to allow the user to screed a second area 106. The same stake may be used for another area, or a plurality of stakes may be used at predetermined locations around the pour so that the person using the tool does not need to waste time driving in a stake while the concrete is being or after the concrete has been poured.

The second area 106 may overlap the first area 104 so that in the process of screening the second area 106, so the user is able to fill in the hole in the concrete left by the initial placement of the framework stake. For larger pours, the same process can be repeated in area after area until the entire surface of the concrete has been screeded and all of the voids left by the framework stake have been filled and covered.

Figure 6:
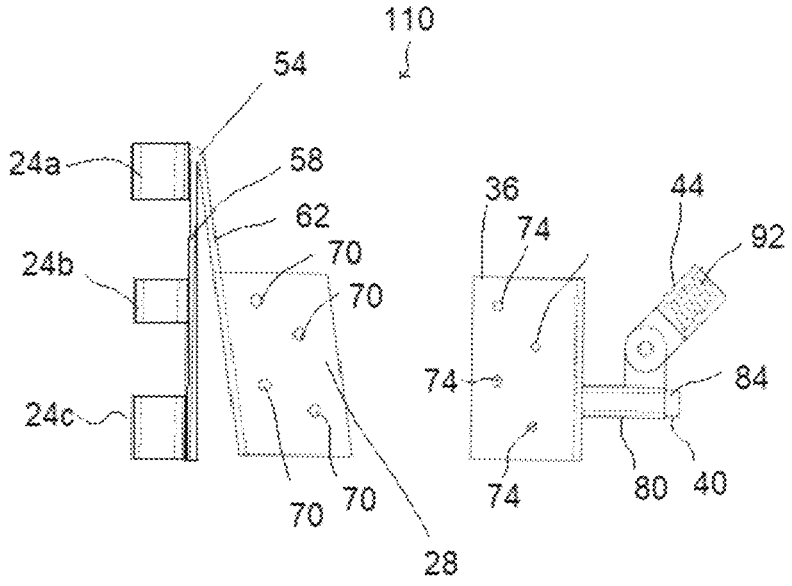
FIG. 6 shows an alternate configuration of the pivot bearing and first attachment bracket disposed on a formwork stake.

Turning now to FIG. 6, there is shown an alternate embodiment of the kit 110. Instead of using a single pivot bearing such as pivot bearing 24 in FIG. 1-4, a plurality of pivot bearings 24*a*, 24*b* and 24*c* are used. These can be welded or mechanically attached to first arm 58 of the hinge 54. The remaining components of the kit 110 are similar to those discussed previously and are numbered accordingly.

Figure 7:
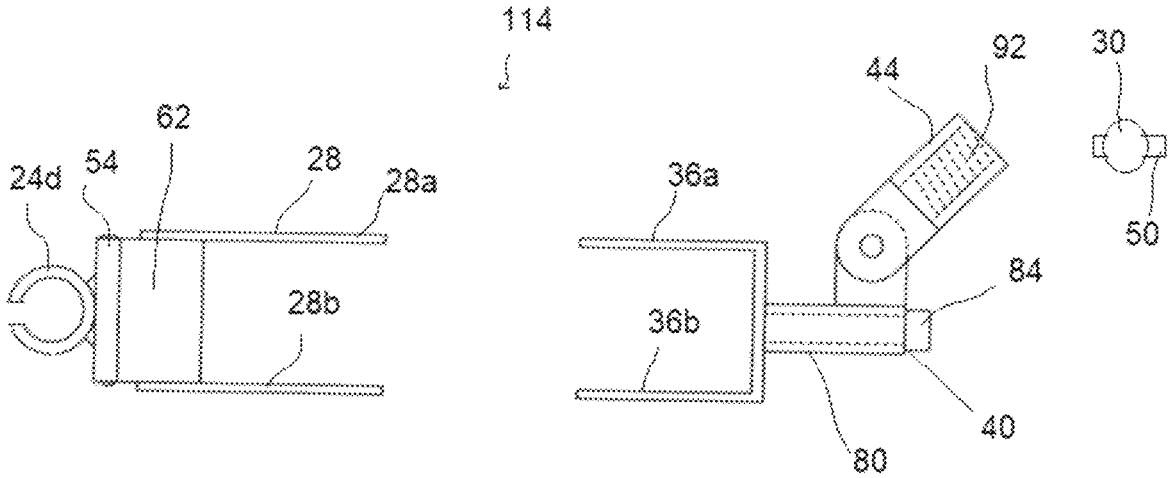
FIG. 7 shows an alternate configuration of the pivot bearing and first attachment bracket disposed about a stake for screening concrete.

FIG. 7 shows a top view of an alternate configuration where in the pivot bearing 24*d* is substantially cylindrical, but has a slot formed therein. The remaining structures are similar to those discussed previously and that discussion is hereby incorporated by reference.

Figure 8:
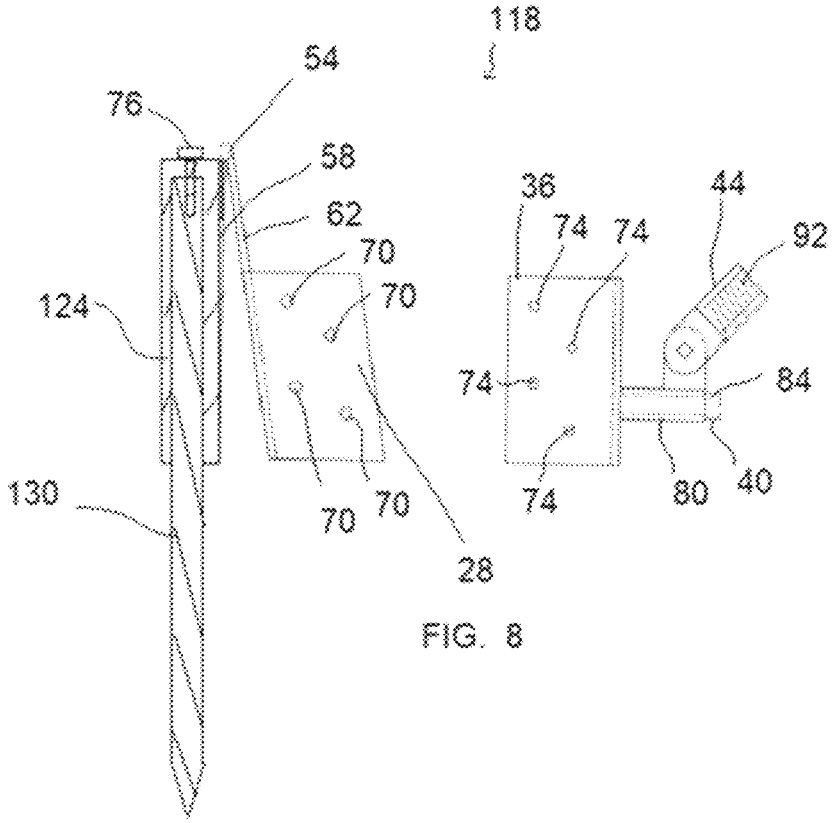
FIG. 8 shows another configuration of a pivot bearing on a formwork stake.

FIG. 8 shows another embodiment of the present disclosure. Rather than using a framework stake with holes, a solid stake 130 may be used with a pivot bearing 124 which has a closed or substantially closed end 124*a* which holds the pivot bearing in place on the stake. In use the user would drive the stake 130 into the surface so that the bottom end of the pivot bearing 124 would be positioned at the desired height for screening concrete. A screw 76 or other fastener may be used to secure the pivot bearing 124 to the stake 130 to prevent the pivot bearing 124 from being lifted off the stake as the screed board passes over the concrete.

In the various embodiments discussed herein, the first attachment bracket 28 is attached to the pivot bearing 24, 124 by a hinge 54. The hinge 54 is not required for use. However, the hinge 54 provides several advantages. First, the hinge allows the worker to lift the screed board to a position which makes working the concrete most efficient without changing the vertical orientation of the stake or the pivot bearing. For example in the process of screeding the user of the concrete working tool 4 may come to a void in the concrete where in the concrete is below the level of the top of the form 12, followed by an area in which the concrete extends above the top. The user can use the hinge 54 to lift the screed board out of contact with the concrete and over the protruding concrete. He or she can then set the screed board back down on the form on the opposing side of the protruding concrete and then work the screed board backward to push the protruding concrete into the board. This is substantially easier than walking the screed board all the way around in the opposing direction to push protruding concrete into voids disposed nearby.

Another advantage of the hinge is that it allows the screed board to follow forms which are placed non-linearly. For example, there may be situations where an owner wants a gentle slope on a portion of concrete to facilitate drainage. The hinge 54 allows the screed board to track a rise or fall in the form to thereby provide the concrete with the desired contour.

As the concrete has been played and excreted, the concrete working tool 4 may be kept as is, or the screens or other fasteners can be removed from the screed board and the pivot bearing removed from the stake to again have the kit. The kit can be kept in a toolbox or other container until it is again needed.

It will be appreciated that the present disclosure teaches a kit for making a concrete working tool, a concrete working tool and a method for using a concrete working tool. While various components of the kit, tool and method are disclosed individually, it will be appreciated that various components can be utilized together in a variety of combinations. For example, a kit for making a tool may include a pivot bearing, a first attachment bracket attached to the pivot bearing, a second attachment bracket; and a handle attachment attached to the second attachment bracket. The pivot bearing may be attached to the first attachment bracket by a hinge. The hinge may have a first arm. The pivot bearing may be welded to the first arm. The hinge may have a second arm and the attachment bracket may have at least one metal plate welded to the second arm. The second attachment bracket may a swivel. The handle attachment may be attached to the swivel. The swivel may include a shank. A swivel bearing may be disposed about the shank. The handle attachment may be attached to the swivel bearing.

The kit for making a tool may have a handle attachment with a threaded void. The handle attachment may also include a pivot. The kit may also include a formwork stake and/or a plurality of retainers. A broom handle may also be included.

The kit may include a pivot bearing which is formed from an elongate tube, or a plurality of pivot bearings. The kit may also include a screed board attachable to the first attachment bracket and the second attachment bracket.

The concrete working tool may include a handle attached to the second attachment bracket. The concrete working tool may also include a stake disposed partially in the pivot bearing.

A method for forming a concrete working tool may include selecting a pivot bearing having a first attachment bracket attached thereto, selecting a second attachment bracket having a handle attachment attached thereto; selecting a stake; and selecting an elongate board; and attaching the elongate board to the first attachment bracket and the second attachment bracket and disposing the stake in the pivot bearing. The method could further include disposing at least one retainer in the stake to limit movement of the pivot bearing along the stake.

A method of screeding concrete may include disposing a stake in the ground, mounting a pivot bearing attached to a first attachment bracket, an elongate board and a second attachment bracket on the stake, positioning the elongate board at a height at which the concrete is to be screeded and rotating the pivot bearing about the stake and screeding concrete. The method may further include the pivot bearing being hingedly attached to the pivot bearing and wherein screeding concrete comprises lifting the elongate board and lowering the concrete board without changing a vertical orientation of the stake and pivot bearing.

Thus, there is disclosed a concrete working tool and a kit for making the same. Those skilled in the art will appreciate numerous modifications which can be made without departing from the scope and spirit of the invention. The appended claims are intended to cover such modifications.

What is claimed is:

1. A kit to attach to a screed board for making a tool to screed concrete, the kit comprising:

a hinge having a first arm and a second arm;

a pivot bearing fixedly attached to the first arm, the pivot bearing having a void extending therethrough sized to receive a formwork stake;

a first attachment bracket attached to the pivot bearing via the hinge, the first attachment bracket being disposed along the second arm, the first attachment bracket having a metal plate extending from the second arm, the metal plate having a plurality of holes formed therein;

a second attachment bracket; and a handle attachment attached to the second attachment bracket.

2. The kit to attach to a screed board for making a tool according to claim 1, further comprising a plurality of fasteners for attaching the metal plate to the screed board.

3. The kit to attach to a screed board for making a tool according to claim 2, wherein the hinge has a first arm and wherein the pivot bearing comprises an elongate tube which is welded to the first arm.

4. The kit to attach to a screed board for making a tool according to claim 1, wherein the second attachment bracket comprises a swivel and wherein the handle attachment is attached to the swivel to enable the handle to rotate from side to side.

5. The kit to attach to a screed board for making a tool according to claim 4, wherein the swivel comprises a shank and a swivel bearing disposed about the shank, the handle attachment being attached to the swivel bearing and wherein the handle attachment further includes a pivot for allowing the handle to pivot toward and away from the second attachment.

6. The kit to attach to a screed board for making a tool according to claim 1, wherein the first attachment bracket has a second metal plate extending from the second arm, the second metal plate being disposed generally parallel to the first metal plate.

7. The kit to attach to a screed board for making a tool according to claim 6, wherein the second metal plate has a plurality of holes formed therein and wherein the kit further comprises a plurality of fasteners for holding a screed board in the first attachment.

8. The kit to attach to a screed board for making a tool according to claim 1, further comprising a formwork stake.

9. The kit to attach to a screed board for making a tool according to claim 8, further comprising a plurality of retainers for insertion into the formwork stakes for positioning the pivot bearing along the formwork stake.

10. The kit to attach to a screed board for making a tool according to claim 9, further comprising a broom handle.

11. The kit to attach to a screed board for making a tool according to claim 1, further comprising a board selected from the group consisting of a 2×4 and a 2×6.

12. The kit to attach to a screed board for making a tool according to claim 1, further comprising a second pivot bearing.

13. A concrete working tool comprising the kit of claim 1, and further comprising a screed board attached to the first attachment bracket and the second attachment bracket.

14. The concrete working tool of claim 13, wherein the screed board is one of a group consisting of a 2×4 and a 2×6.

15. A concrete working tool comprising the kit of claim 1, further comprising a generally cylindrical formwork stake disposed partially in the pivot bearing, the generally cylindrical formwork stake having a conical bottom for driving into soil.

16. A method for forming a concrete working tool comprising:

selecting a hinge having a first arm with a pivot bearing disposed thereon and having second arm having a first attachment bracket disposed thereon, the attachment bracket comprising a metal plate having a plurality of holes formed therein;

selecting a second attachment bracket having a handle attachment attached thereto, the second attachment bracket comprising a metal plate with a plurality of holes formed herein; selecting a formwork stake; and selecting an elongate board; and attaching the elongate board to the first attachment bracket and the second attachment bracket and disposing the formwork stake in the pivot bearing.

17. The method according to claim 16, wherein the formwork stake has a hole and wherein the method further comprises disposing at least one retainer in the hole in the formwork stake to limit downward movement of the pivot bearing along the stake.

18. A method of screeding concrete disposed on a surface comprising:

driving a stake into the surface;

pouring concrete onto the surface;

before or after pouring concrete on the surface, mounting a pivot bearing attached to a first attachment bracket, an elongate board and a second attachment bracket on the stake;

positioning the elongate board at a height at which the concrete is to be screeded; and rotating the pivot bearing about the stake and screeding concrete.

19. The method of screeding concrete according to claim 18, where in the first attachment bracket is hingedly attached to the pivot bearing and wherein screeding concrete comprises lifting the elongate board and lowering the elongate board without changing a vertical orientation of the stake and pivot bearing.

20. A kit for making a tool, the kit comprising:

a pivot bearing;

a first attachment bracket attached to the pivot bearing;

a second attachment bracket; and a handle attachment attached to the second attachment bracket;

wherein the pivot bearing is attached to the first attachment bracket by a hinge; wherein the hinge has a first arm and wherein the pivot bearing is welded to the first arm; and wherein the hinge has a second arm and wherein the first attachment bracket comprises at least one metal plate welded to the second arm.

* * * * *